US005139321A

United States Patent [19]

Beardsley

[11] Patent Number: 5,139,321

[45] Date of Patent: Aug. 18, 1992

[54] MULTIPLE-BIN TRAY ASSEMBLY FOR A MEDICAL DISPENSING CASSETTE

[75] Inventor: Duane I. Beardsley, Berrien Springs, Mich.

[73] Assignee: Artromick International, Inc., Columbus, Ohio

[21] Appl. No.: 643,460

[22] Filed: Jan. 18, 1991

[51] Int. Cl.[5] ..... A47B 81/00

[52] U.S. Cl. ..... 312/209; 312/301; 312/308

[58] Field of Search ..... 312/209, 293, 298, 301, 312/308, 330.1, 348, 244, 320, 216, 332; 384/20, 21

[56] References Cited

U.S. PATENT DOCUMENTS 1,692,805 11/1928 Anderson ..... 312/337
1,728,946 9/1929 Tobey ..... 312/308 X
1,929,762 10/1933 Ulrich ..... 312/301
1,993,477 3/1935 Gourley et al. ..... 312/301
2,037,881 4/1936 Clark ..... 312/308 X
2,479,626 8/1949 Klein ..... 312/348
3,834,778 9/1974 Morrison et al. ..... 312/330.1
4,453,790 6/1984 Cohen et al. ..... 312/348
4,616,890 10/1986 Romick .
4,958,891 10/1990 Taylor et al. .

*Primary Examiner*—Kenneth J. Dorner
*Assistant Examiner*—Brian K. Green
*Attorney, Agent, or Firm*—Wood, Herron & Evans

[57] ABSTRACT

Disclosed is a multiple bin tray assembly having individual medication bins positioned inside a tray which in turn is fitted into a cassette. Each bin can be opened individually from the cassette to minimize accessibility to the remaining bins and thus decrease the risk of accidental dispensing of medication. The cassette with this novel tray assembly can be fitted into a medication cart of standard dimension.

9 Claims, 5 Drawing Sheets

MULTIPLE-BIN TRAY ASSEMBLY FOR A MEDICAL DISPENSING CASSETTE

FIELD OF THE INVENTION

The invention relates to a multiple-bin tray assembly which provides a more secure, tamper-resistant storage area for storing medications by limiting access to individual bins. The invention is particularly useful as a component of a medication cart for use in hospitals, nursing homes and other long-term health care facilities.

BACKGROUND OF THE INVENTION

In hospitals, nursing homes and other long-term care facilities, patients typically receive a number of different medications which are administered on a continuing basis. Preferably, each patient has a personalized container for the storing of his or her own medications. This practice simplifies dispensing of the medications and also aids in verifying the actual medications dispensed. One manufacturer of such medication containers, or storage trays, is Artromick International, Columbus, Ohio. Artromick International produces a variety of medication storing and dispensing equipment, including cassettes with storage bins and trays, as well as medication carts having multiple slots of a standard dimension for retaining various combinations of cassettes with storage bins, trays and shelves used to store the medications and equipment needed for the patients. Other systems do not utilize cassettes for retaining trays and storage bins.

The medication for a single patient typically does not require the storage area of an entire storage tray in a medication cart. Instead, the patient's medications are stored in a single bin of lesser dimension, several of which can be positioned side-to-side in the standard dimension space normally occupied by a tray. The single bin can be inserted in a mating slot built into the medication cart or cassette to provide a secure storage space for the medications. However, a medication cart or cassette having individual bin slots requires that that space in the cart or cassette be dedicated to that function of transporting only individual patient's medication bins. This defeats the purpose of standard dimension slots in the medication cart or cassette which allows interchanging of trays and shelves to maximize efficiency of use of the cart in the particular application.

In use, individual patient bins are stored in this type of medication cart by positioning the bins side-to-side on a storage tray, the tray then being retained in a slot in the medication cassette, the cassette being retained in the medication cart. To access a patient's bin, the tray is pulled from the medication cassette, exposing the bin contents. Unfortunately, opening the single tray also allows access to the medications in the bins of other patients. The access so provided creates a risk that the other medications will be accidentally removed from their proper storage site.

BRIEF DESCRIPTION OF THE INVENTION

The invention herein described relates to a tray assembly of a standard dimension having multiple bins for storing medications wherein individual bins may be opened without providing access to the remaining bins on the tray. The tray is mountable in a tray housing having slots to accept the tray and guides on the side walls of the slots which mate with tracks on the side of the tray. The tray housing can be a medication cart, but is preferably a medication cassette, which is described in more detail herein. The individual bins are positioned on the tray such that a handle on each bin is located at the front of the tray. A single bin is opened by pulling on the handle, which moves the entire tray forward a short distance to a first stop position which provides no access to the individual bins. Next, the bin is pulled upward and outward using the handle to separate the bin from the tray, which remains in the first stop position. This second step allows one to access the single bin without providing access to the remaining bins. Movement of the tray beyond the first stop position is rendered more difficult by making the tray track slightly convex. Thus, a portion of the track is in close contact with the guide when the tray is closed. This portion must be deformed if the tray is to be moved past the first stop position.

It is thus an object of the invention to provide a medication storage tray with multiple bins having improved safety against accidental dispensing of medication to the wrong patient.

It is a further object of the invention to provide a medication storage tray with multiple bins wherein a single bin can be removed without providing access to the remaining bins within the tray.

It is yet a further object of the invention to provide a medication storage tray with multiple bins wherein the tray can be opened to a first stop position to access individual bins, and then opened further only with additional effort to expose all bins simultaneously.

It is an advantage of the invention that the storage tray itself can be opened to a second stop position to permit access to all bins simultaneously, and opened further to permit removal of the entire storage tray, with bins, from the tray housing, such as a medication cassette.

These and other objects and advantages will be further explained and described in the following text and drawings in which:

DETAILED DESCRIPTION OF THE INVENTION

The invention in its broader aspects relates to a multiple bin tray assembly comprising a tray housing having side walls with an interior guide on each side wall and a detent on each guide; a tray having a front lip and tracks extending outwardly along each side of the tray to slidably engage the interior guides of the tray housing, and a projection on at least one track to engage the detent on the interior guide of the tray housing to limit further outward sliding movement of the tray from the housing; and at least one bin fitting inside the tray, having a front stop rib which engages the front lip of the tray, and a handle on the front thereof. To facilitate closure of the tray, the tray will preferably have a rear lip which will cause the tray to retract into the tray housing when pressure is applied to the handle on the individual bin, due to contact of the back wall of the bin with the rear lip of the tray. Preferably, to maximize the useful space in each bin, the bin will be substantially as long as the tray itself. The preferred tray housing is a medication cassette.

Figure 1:
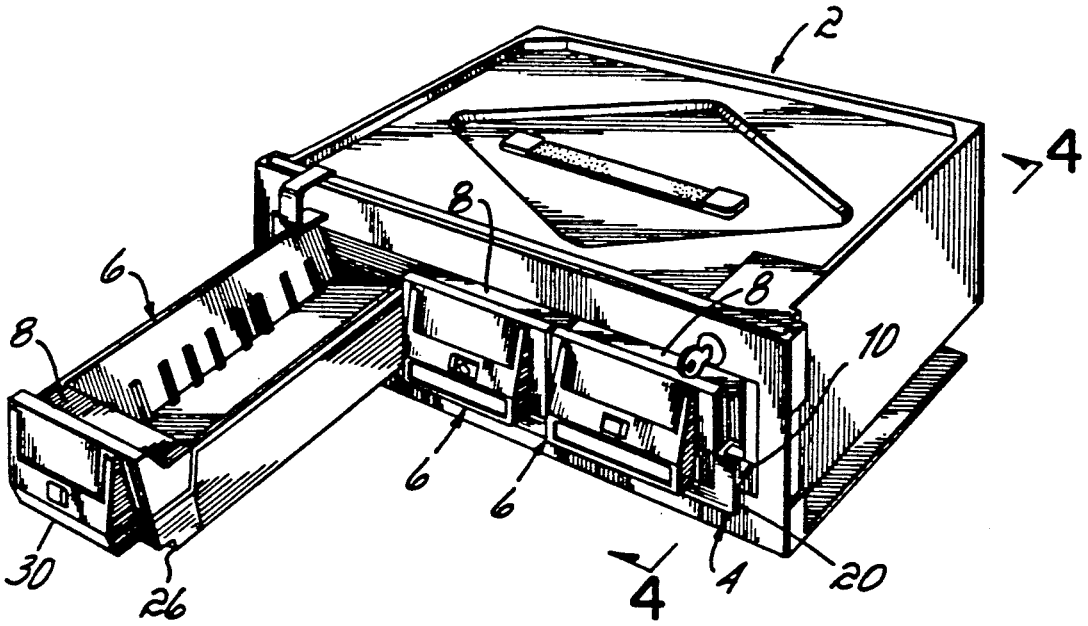
FIG. 1 is a perspective view of a cassette showing the tray holding multiple bins partially extended and a single bin fully extended.

Referring to the drawings, FIG. 1 depicts a cassette 2, which retains tray 4 and individual medication bins 6. The cassette 2 is designed to fit into a medication cart (not shown), and both the medication cart and cassette 2 are more fully described in U.S. Pat. No. 4,616,890, to Romick et al., which is incorporated herein by reference.

Figure 2:
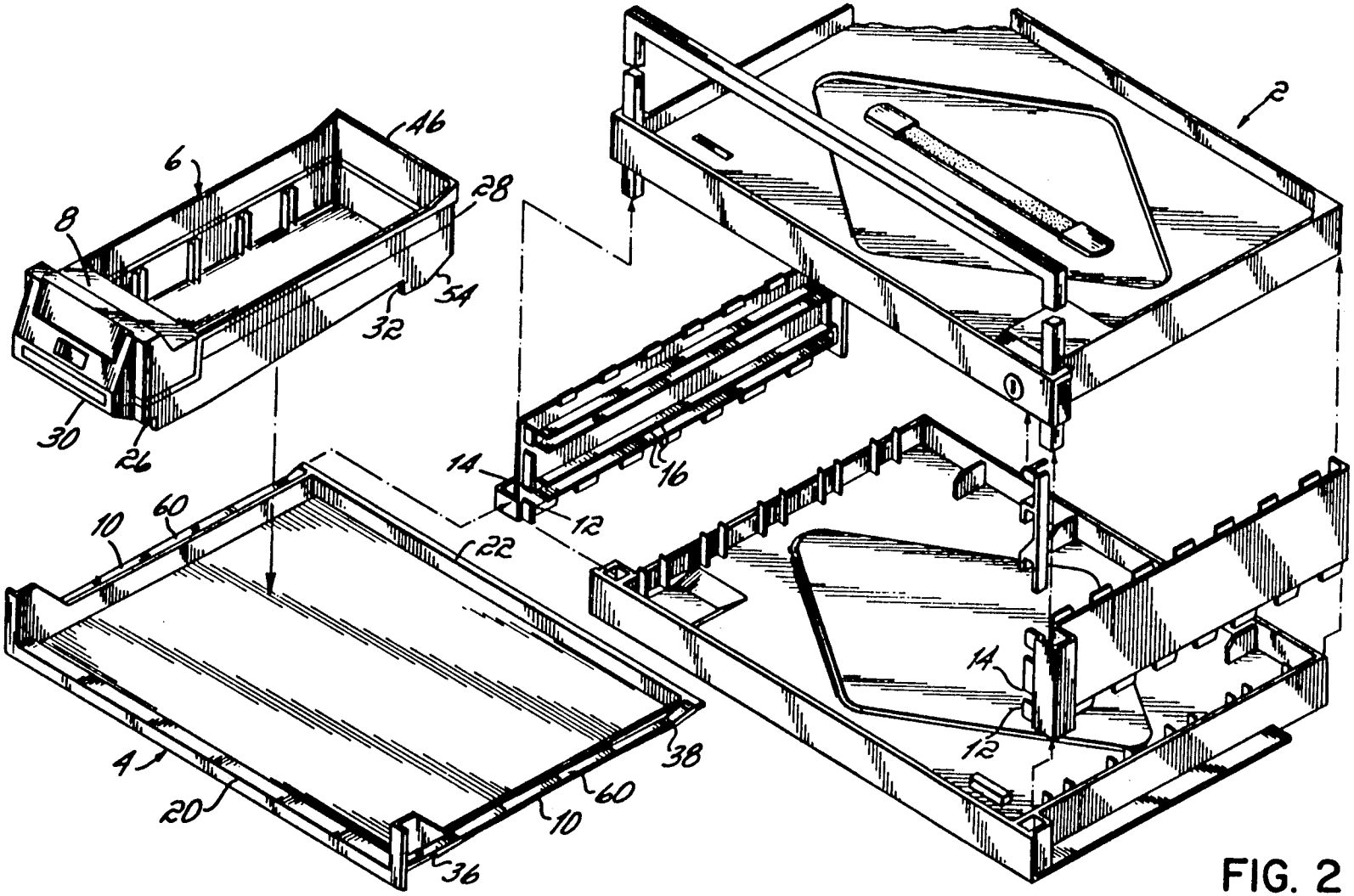
FIG. 2 is an exploded view in perspective of the cassette shown in FIG. 1, further depicting the multiple bin tray and a single bin for positioning inside said tray.

FIG. 2 depicts an exploded version of the cassette 2 to show the relationship between the cassette 2, tray 4, and bin 6 in more detail. Medications are stored in bin 6 behind bin security shelf 8. Tray 4 has two outwardly extending tracks 10 which are connected to the sides thereof. Tracks 10 enter cassette 2 through apertures defined by detent 12 and projection 14 to thereby slidably engage guides 16.

Tray 4 has a front lip 20 and a rear lip 22. Bin 6 fits into tray 4, with front stop rib 26 resting against the inside of front lip 20, and the back wall 28 of bin 6 positioned adjacent the inside of rear lip 22. The bin 6 is moved in and out from the cassette 2 by grasping handle 30. Located between the front stop rib 26 and back wall 28 of bin 6 is rear stop rib 32.

Figure 3:
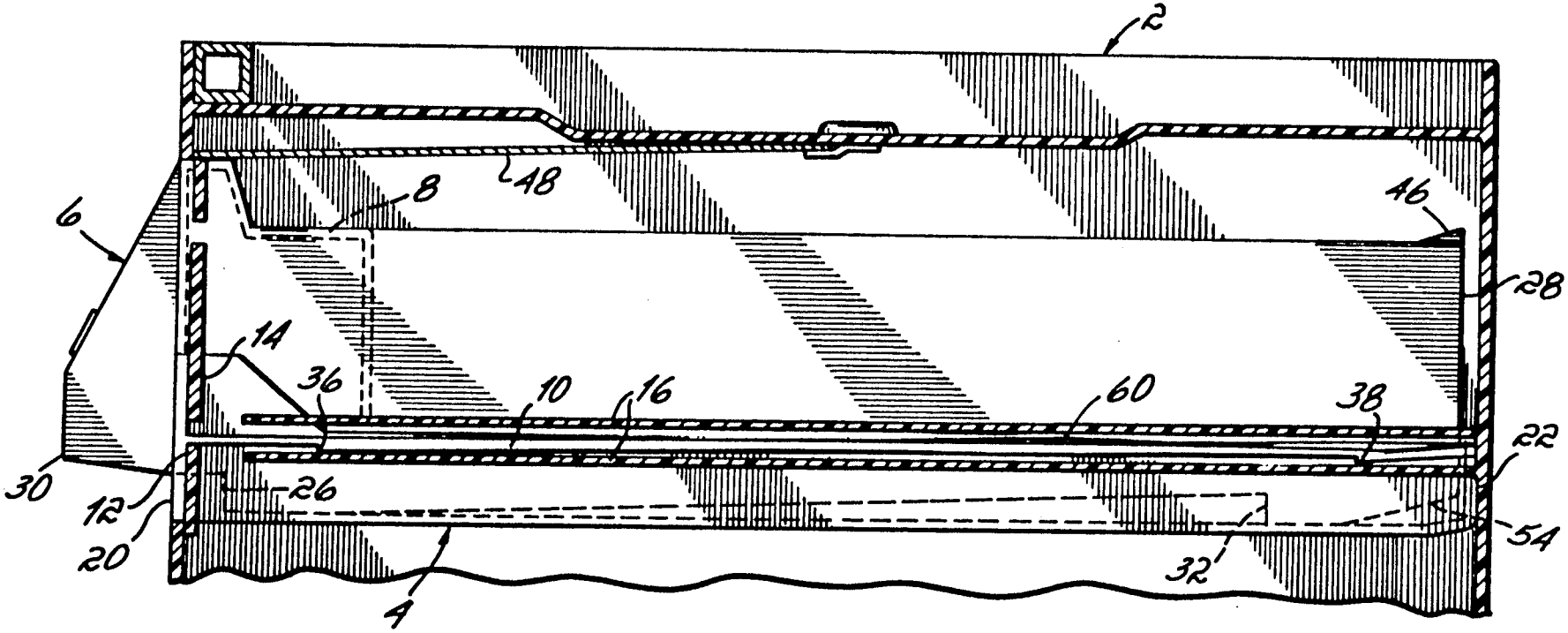
FIG. 3 is a side view, in section, depicting the guide and track assembly for retaining the tray in a medication cassette.
Figure 4:
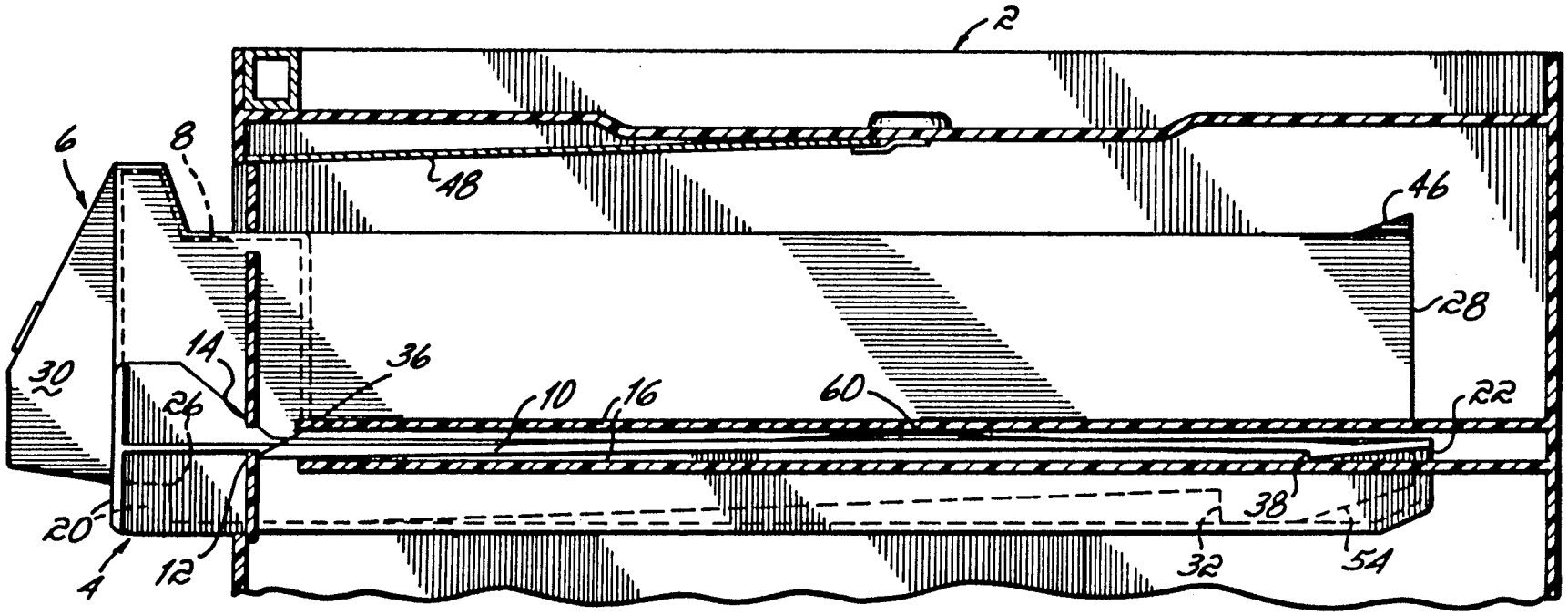
FIG. 4 is a side view, in section, taken along lines 4—4 from FIG. 1, depicting the tray and bin partially extended from the medication cassette.
Figure 5:
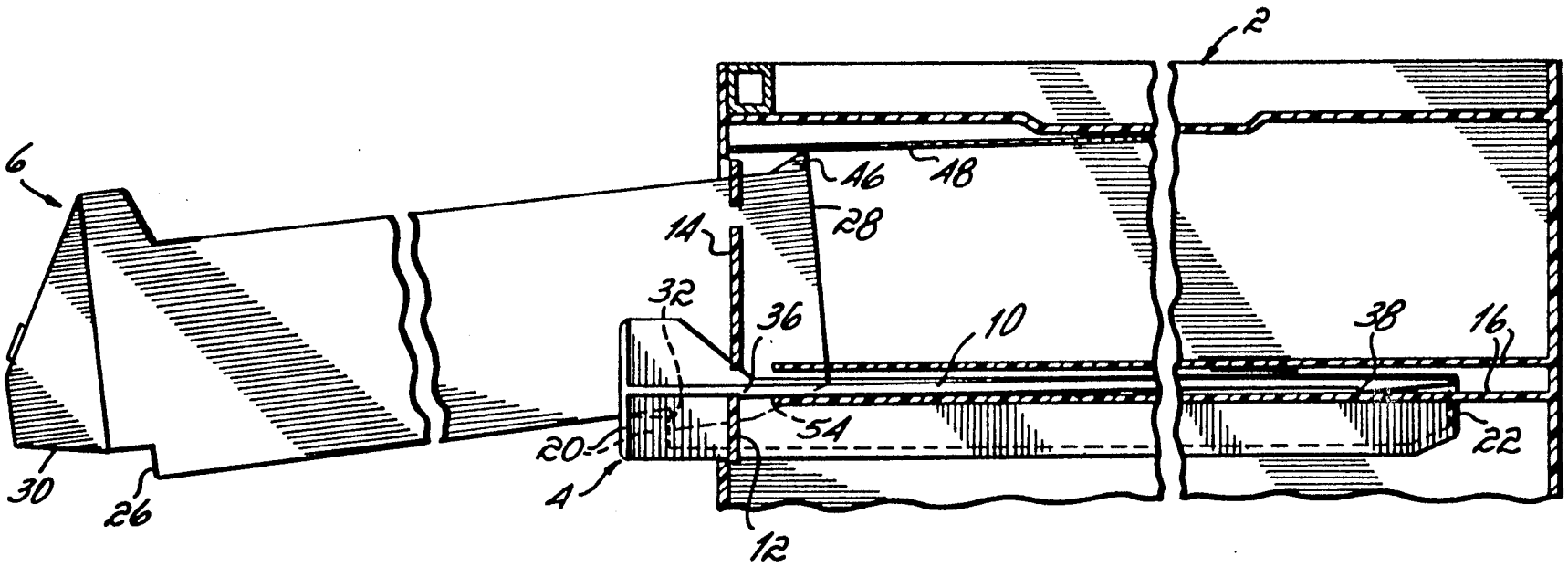
FIG. 5 is a partial side view depicting the tray and bin of FIG. 4, but with the bin in the fully extended position.

The mechanism defining the movement of bin 6 relative to the cassette 2 is described in more detail in FIGS. 3, 4 and 5.

FIG. 3 depicts tray 4 and bin 6 in cassette 2 in the fully closed position. The figure shows track 10 of tray 4 having a first track stop 36 and second track stop 38.

In FIG. 4, the tray 4 and bin 6 have been partially opened. Grasping handle 30 and pulling outward causes the front stop rib 26 of bin 6 to contact the inside of front lip 20 to cause track 10 of tray 4 to slide along guide 16. Further outward movement causes the first track stop 36 to contact detent 12 at the front of cassette 2 to thereby stop forward movement of both the tray 4 and bin 6. In this position, only bin security shelf 8 is exposed at the top, thereby preventing access to the interior of the bin.

Grasping handle 30 and pulling upward and outward from the cassette 2 causes the front stop rib 26 of bin 6 to break contact with the inside of front lip 20 of tray 4. Tray 4 remains in its partially open position, stopped by first track stop 36 at detent 12. The bin 6 can then be extended substantially completely until rear stop rib 32 contacts the inside of front lip 20 of tray 4. This is shown in more detail in FIG. 5. The combined weight of the contents and the bin causes the bin to tilt downward. This downward motion is restricted by the contact of upper angle member 46 of bin 6 with roof member 48 of cassette 2. In medication carts having multiple trays arranged one above the other, the angle member 46 of bin 6 will contact the bottom of tray 4 mounted directly above. Only with the topmost tray in a medication cart will the angle member 46 of bin 6 contact roof member 48.

Additional exertion on handle 30 upward and outward from the cassette 2 causes the rear stop rib 32 to break contact with the inside of front lip 20 to thereby allow the bin to be removed completely from the cassette 2 and tray 4. Removal of bin 6 is facilitated by the design of bottom angle portion 54 on bin 6. By reversing the direction of exertion on bin 6, the bin can be replaced into the cassette 2 above tray 4 until the back wall 28 contacts the inside of rear lip 22 of tray 4. Further inward exertion on handle 30 causes track 10 of tray 4 to slide along guide 16 until both tray 4 and bin 6 are in the fully closed position, as shown in FIG. 3, along with all other bins in the same tray.

If it is desired to extend tray 4 beyond the partially opened position defined by first track stop 36, upward and outward exertion applied to the exposed underside of tray 4 will cause first track stop 36 to break contact with detent 12 and allow further sliding of track 10 along guide 16 until second track stop 38 contacts detent 12. Because of the risk of tampering when multiple bins 6 are exposed, further extension of tray 4 past first track stop 36 is rendered more difficult by a spring-latch effect caused by the shape of the track 10 relative to guide 16, as shown in FIG. 4. Approximately midway along track 10 is a convex portion 60 which nearly contacts the upper frictional surface of guide 16 when the tray 4 is in the fully retracted and partially extended positions. When it is desired to open tray 4 beyond the partially opened position, first track stop 36 must be lifted past detent 12. However, the upward exertion to the underside of tray 4 to lift first track stop 36 past detent 12 causes the convex portion 60 of track 10 to contact the upper frictional surface of guide 16 and render outward movement of the tray 4 more difficult. Requiring increased exertion on the tray 4 for additional outward movement reduces the risk of exposing multiple bins simultaneously. The tray 4 can be completely removed from cassette 2 by additional upward and outward exertion directed to the exposed underside of tray 4 to cause second track stop 38 to break contact with detent 12.

The multiple bin tray of this invention allows a single bin to be removed from cassette 2 without providing access to any other bins located on the same tray 4. The individual bin 6 can be opened substantially completely to access the entire interior of the bin 6, or can alternatively be removed completely from the cassette for cleaning, repacking of medications, or the like. Also, if desired, all bins can be accessed simultaneously by opening the tray 4 substantially completely, or alternatively by removing the tray 4 from the cassette completely. The cassette 2 itself can be transported by hand by an attendant, or alternatively, can be stored in a medication cart (not shown) of standard dimension to accept the cassette therein, to facilitate the dispensing of larger amounts of medications to larger numbers of patients. In the embodiment as depicted, the tray 4 and bin 6 are molded from high impact polystyrene (HIPS), a blend of butadiene and styrene. The top, bottom and sides of the cassette 2 are constructed from a polymer blend of acrylonitrile-butadiene-styrene (ABS). It is preferred that the tray 4 and bin 6 be constructed from a different material than the cassette 2, because slightly better sliding friction results between mating surfaces. Generally, the materials to make the tray 4, bin 6 and cassette 2 should be tough, durable, and stable to ultraviolet radiation and contact with chemicals. Particularly, the materials should be inert to those chemicals, including solvents, antiseptics, and the like, which are commonly encountered in a patient care facility. Thus, it is envisioned that other structurally stable materials may be used with comparable results.

Having thus described the invention, what is claimed is:

1. A multiple bin tray assembly comprising;

a tray housing having side walls with an interior guide on each of said side walls, and a detent on each said guide;

a tray having a front lip with tracks extending outwardly along each side of said tray to slidably engage said interior guides of said tray housing, and a projection on at least one said track to engage said detent on said interior guide of said tray housing to limit further outward sliding movement of said tray from said tray housing, further wherein at least one said track of said tray has a deformable convex portion, said convex portion deforming on contact with said interior guide mating therewith when said projection is disengaged from said detent to obtain further outward sliding movement of said tray from said tray housing; and at least one bin having a front and a back inside said tray, having a front stop rib to engage said front lip of said tray, and a handle on said front thereof.

2. The tray assembly of claim 1 wherein said tray has a rear lip.

3. The tray assembly of claim 1 wherein said bin is substantially the same length as said tray.

4. The tray assembly of claim 1 wherein said bin has a rear stop rib for engaging said front lip of said tray to prevent accidental removal of said bin from said tray assembly.

5. The tray assembly of claim 1 wherein said tray housing is a medication cassette.

6. The tray assembly of claim 1 wherein said tray has more than one bin therein.

7. The tray assembly of claim 1 wherein said tray extends from said tray housing to provide simultaneous access to each said bin.

8. A tray assembly having multiple bins therein comprising;

a cassette having side walls with an interior guide on each said side wall, and a detent on each said guide;

a tray having a front lip and rear lip, with tracks extending outwardly along each side of said tray to slidably engage said interior guides of said cassette, and a projection on each said track to engage said detent on said interior guide of said cassette to limit further outward sliding movement of said tray from said cassette, further wherein each said track of said tray has a deformable convex portion, said convex portion deforming on contact with each said interior guide mating therewith when said projection is disengaged from said detent to obtain further outward sliding movement of said tray from said cassette; and at least one bin inside said tray, having a front stop rib and rear stop rib able to engage said front lip of said tray, and a length substantially the same as said tray, and a handle on a front thereof.

9. The tray assembly of claim 8 wherein said tray has more than one bin therein.

* * * * *